US010871005B2

(12) United States Patent
Olivo et al.

(10) Patent No.: US 10,871,005 B2
(45) Date of Patent: Dec. 22, 2020

(54) PORTABLE, INFLATABLE MATTRESS WITH TENT ATTACHMENT

(71) Applicants: Inger Olivo, Austin, TX (US); John Peyton, Austin, TX (US)

(72) Inventors: Inger Olivo, Austin, TX (US); John Peyton, Austin, TX (US)

( * ) Notice: Subject to any disclaimer, the term of this patent is extended or adjusted under 35 U.S.C. 154(b) by 378 days.

(21) Appl. No.: 15/862,289

(22) Filed: Jan. 4, 2018

(65) Prior Publication Data

US 2018/0195308 A1 Jul. 12, 2018

Related U.S. Application Data

(63) Continuation-in-part of application No. 14/788,084, filed on Jun. 30, 2015, now Pat. No. 9,913,767.

(51) Int. Cl.

| | |
|---|---|
| ***E04H 15/02*** | (2006.01) |
| ***E04H 15/20*** | (2006.01) |
| ***E04H 15/40*** | (2006.01) |
| ***A61G 7/10*** | (2006.01) |
| ***A61G 1/013*** | (2006.01) |
| ***A61G 1/003*** | (2006.01) |

(Continued)

(52) U.S. Cl.

CPC ..... *E04H 15/02* (2013.01); *A61G 1/003* (2013.01); *A61G 1/013* (2013.01); *E04H 15/20* (2013.01); *E04H 15/405* (2013.01); *A61G 1/04* (2013.01); *A61G 1/044* (2013.01); *A61G 1/048* (2013.01); *A61G 7/1021* (2013.01); *E04H 15/42* (2013.01); *E04H 15/44* (2013.01); *E04H 2015/208* (2013.01)

(58) Field of Classification Search

CPC ..... E04H 15/02; E04H 15/20; E04H 15/405; E04H 15/42; E04H 15/44; E04H 2015/208; A61G 7/1021; A61G 1/003; A61G 1/013; A61G 1/04; A61G 1/044; A61G 1/048

See application file for complete search history.

(56) References Cited

U.S. PATENT DOCUMENTS 3,058,127 A * 10/1962 Hassold ..... B63C 9/02 441/38
3,131,406 A * 5/1964 Cousteau ..... B63B 17/02 441/38

(Continued)

OTHER PUBLICATIONS

Inger Olivo & John Peyton, Picture of preliminary prototype during developmental stage of inflatable mattress, 1 page, picture provided as Display Only on clipboard (no additional copies of picture were taken or provided), National Funeral Directors Association conference, Jun. 12-13, 2013.

*Primary Examiner* — David R Hare

(74) *Attorney, Agent, or Firm* — Kowert, Hood, Munyon, Rankin & Goetzel, P.C.; Gareth M. Sampson

(57) ABSTRACT

An inflatable apparatus is disclosed that includes an inflatable mattress with a tent coupled to the inflatable mattress. The inflatable mattress may include an inflatable mattress chamber with two elongated inflatable chambers attached to the inflatable mattress chamber. The two elongated inflatable chambers may provide support and stability for the inflatable mattress chamber. The tent may be a collapsible tent coupled to the inflatable mattress chamber. The inflatable mattress and the tent, when deflated and collapsed, respectively, may be rolled-up or folded-up into a compact state for transport and/or storage.

17 Claims, 7 Drawing Sheets

(51) Int. Cl.

| | |
|---|---|
| *A61G 1/04* | (2006.01) |
| *A61G 1/048* | (2006.01) |
| *A61G 1/044* | (2006.01) |
| *E04H 15/42* | (2006.01) |
| *E04H 15/44* | (2006.01) |

(56) References Cited

U.S. PATENT DOCUMENTS

| | | | | |
|---|---|---|---|---|
| 3,775,782 | A | 12/1973 | Rice et al. | |
| 4,251,959 | A * | 2/1981 | Hsu | E04H 15/20 441/129 |
| 4,301,791 | A | 11/1981 | Franco, III | |
| 4,466,145 | A * | 8/1984 | Jones | A61G 1/00 441/40 |
| 4,766,918 | A * | 8/1988 | Odekirk | E04H 15/02 114/345 |
| 5,421,757 | A * | 6/1995 | Basiliere | B63C 9/04 441/128 |
| 5,642,750 | A | 7/1997 | Brown et al. | |
| 5,660,197 | A | 8/1997 | Boe et al. | |
| 6,053,534 | A * | 4/2000 | Timmerman | A62B 1/02 280/17 |
| 6,073,291 | A | 6/2000 | Davis | |
| 6,167,898 | B1 * | 1/2001 | Larga | E04H 15/20 135/124 |
| 6,367,404 | B1 * | 4/2002 | Callahan | B63B 7/082 114/353 |
| 6,623,322 | B1 * | 9/2003 | Lesniak | B63B 7/085 114/345 |
| 6,701,544 | B2 | 3/2004 | Heimbrock | |
| 6,775,868 | B1 | 8/2004 | Mileti et al. | |
| 6,964,073 | B1 | 11/2005 | Curry | |
| 7,056,178 | B1 * | 6/2006 | Chung | B63C 9/04 135/95 |
| 7,114,204 | B2 | 10/2006 | Patrick | |
| 7,174,584 | B2 | 2/2007 | Danaher | |
| 7,406,723 | B2 | 8/2008 | Davis | |
| 7,735,164 | B1 | 6/2010 | Patrick | |
| 8,011,986 | B1 * | 9/2011 | Curtsinger | B63B 2035/442 441/35 |
| 8,234,727 | B2 | 8/2012 | Schreiber et al. | |
| 8,328,592 | B2 | 12/2012 | Cynamon | |
| 8,550,538 | B1 | 10/2013 | Brandenburg | |
| 9,259,368 | B2 | 2/2016 | Jensen et al. | |
| 9,511,828 | B1 * | 12/2016 | Branch | B63C 9/21 |
| 9,624,688 | B1 | 4/2017 | Tyson | |
| 9,913,767 | B2 | 3/2018 | Olivo et al. | |
| 2002/0166168 | A1 | 11/2002 | Weedling et al. | |
| 2003/0106155 | A1 | 6/2003 | Arai | |
| 2005/0283905 | A1 * | 12/2005 | Johnson | A61G 7/1028 5/81.1 R |
| 2008/0289102 | A1 | 11/2008 | Davis | |
| 2010/0083995 | A1 | 4/2010 | Sanders | |
| 2012/0284923 | A1 | 11/2012 | Jensen et al. | |
| 2014/0199901 | A1 * | 7/2014 | Ibsen | B63C 9/04 441/42 |
| 2014/0232156 | A1 | 8/2014 | Mills | |
| 2014/0295721 | A1 * | 10/2014 | Jensen | A61G 1/013 441/129 |
| 2015/0283007 | A1 | 10/2015 | Carlson | |

* cited by examiner

PORTABLE, INFLATABLE MATTRESS WITH TENT ATTACHMENT

PRIORITY CLAIM

This patent application is a continuation-in-part of U.S. patent application Ser. No. 14/788,084 entitled "PORTABLE, INFLATABLE MATTRESS FOR LIFTING AND TRANSPORTING CORPSES" to Olivo et al., filed Jun. 30, 2015, which is incorporated by reference in its entirety.

BACKGROUND

1. Field of the Invention

The present invention relates to an inflatable sleeping apparatus. More particularly, the invention relates to an inflatable mattress with a tent attachment suitable for camping.

2. Description of Related Art

There are various types of tents with integrated inflatable mattresses known in the art. For example, U.S. Pat. Nos. 4,251,959; 5,642,750; 5,660,197; 6,167,898; 7,174,584; 8,550,538; 9,624,688 describe various versions of tents integrated with inflatable mattresses. While the prior art devices include different designs and structures for tents integrated with inflatable mattresses, there remains a need for simple, compact integrated tent/mattress structures that are easily transportable and convenient for user's to deploy.

SUMMARY

In certain embodiments, an inflatable apparatus includes an inflatable mattress having an inflatable mattress chamber in fluid communication with two elongated inflatable chambers. The two elongated inflatable chambers may be positioned lengthwise along longitudinal edges of the inflatable mattress chamber. The two elongated inflatable chambers may be positioned at least partially underneath the longitudinal edges of the inflatable mattress chamber. An inflation device may be coupled to the inflatable mattress chamber and the two elongated inflatable chambers. The inflation device may be used to inflate the inflatable mattress chamber and the two elongated inflatable chambers to raise the inflatable mattress chamber to a selected inflated height. When inflated, the two elongated inflatable chambers may have an inflated height where a lower planar surface of the inflatable mattress chamber is in tangential contact with both of the two elongated inflatable chambers along their outer surfaces at the inflated height of the two elongated inflatable chambers. A tent (e.g., portable shelter) may be coupled (e.g., attached) to an upper surface of the inflatable mattress chamber.

In certain embodiments, an inflatable apparatus includes an inflatable mattress chamber and two elongated inflatable chambers in fluid communication with the inflatable mattress chamber. The two elongated inflatable chambers may be positioned lengthwise along longitudinal edges of the inflatable mattress chamber. An inflation device may be coupled to the inflatable mattress chamber and the two elongated inflatable chambers. The inflation device may be used to inflate the inflatable mattress chamber and the two elongated inflatable chambers to raise the inflatable mattress chamber to a selected inflated height. A tent (e.g., portable shelter) may be coupled to an upper surface of the inflatable mattress chamber.

In some embodiments, the two elongated inflatable chambers are positioned at least partially underneath the longitudinal edges of the inflatable mattress chamber with the longitudinal edges of the inflatable mattress chamber extending wider than centers of the two elongated inflatable chambers. In some embodiments, the two elongated inflatable chambers are positioned at least partially underneath the longitudinal edges of the inflatable mattress chamber and, when the two elongated inflatable chambers and a lower surface of the inflatable mattress chamber are at the selected inflated height, the lower surface of the inflatable mattress chamber is in contact with uppermost inflated points of the two elongated inflatable chambers. The uppermost inflated points may be the uppermost points with respect to a ground surface configured for the two elongated inflatable chambers.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings in which.

Figure 1:
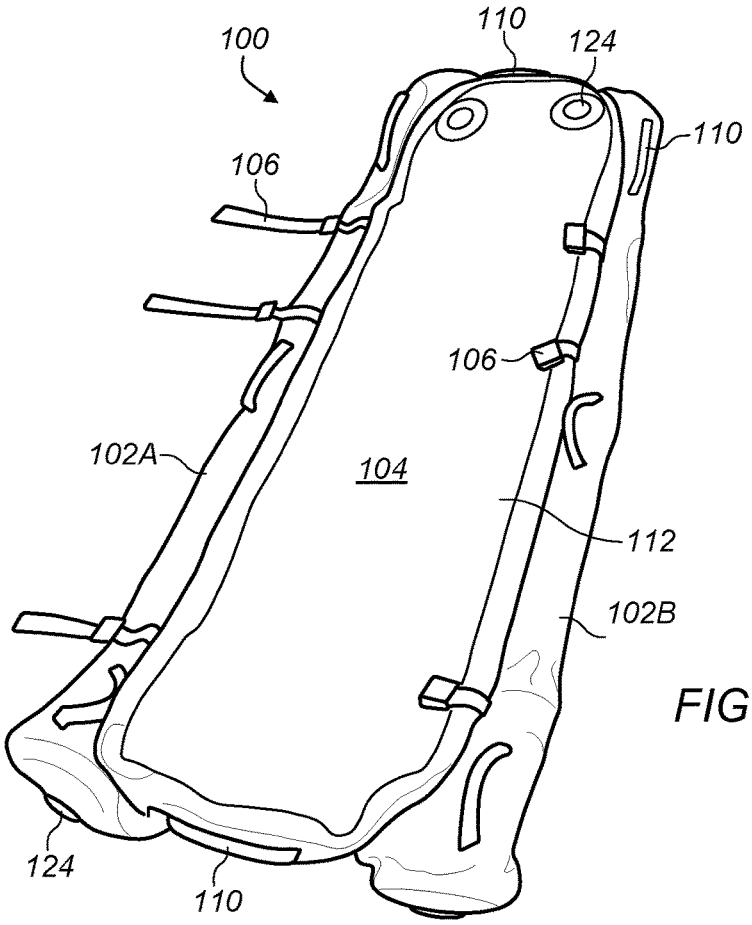
FIG. 1 depicts a top perspective view of an embodiment of an inflatable mattress in a deflated state.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION OF EMBODIMENTS

In the context of this patent, the term "coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

Figure 2:
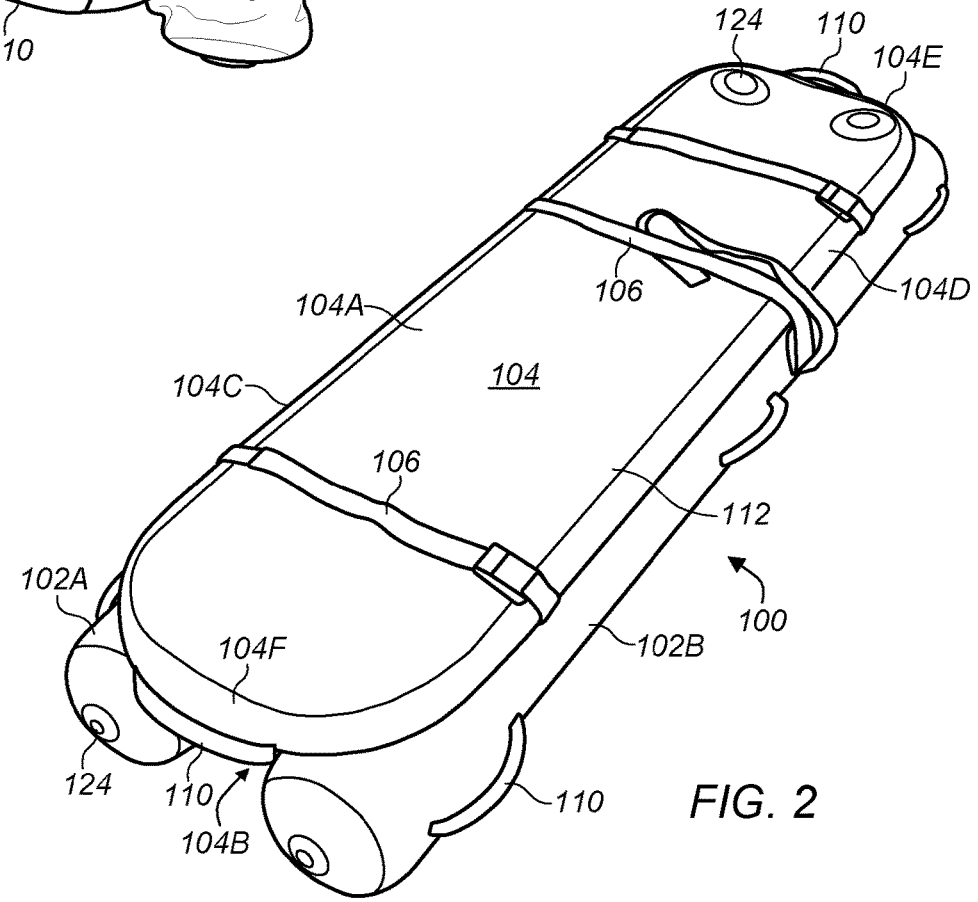
FIG. 2 depicts a top perspective view of an embodiment of an inflatable mattress in an inflated state.
Figure 3:
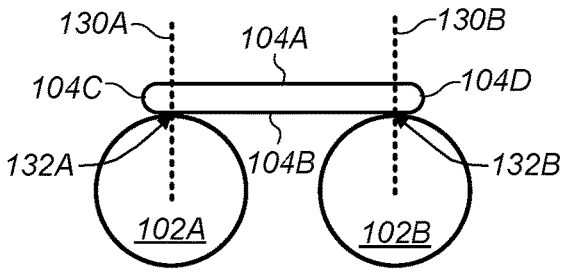
FIG. 3 depicts an end view sectional representation of an embodiment of an inflatable mattress in an inflated state.

FIG. 1 depicts a top perspective view of an embodiment of inflatable mattress 100 in a deflated state. FIG. 2 depicts a top perspective view of an embodiment of inflatable mattress 100 in an inflated state. FIG. 3 depicts an end view sectional representation of an embodiment of inflatable mattress 100 in an inflated state. In some embodiments, mattress 100 is used for lifting and transporting a human corpse. In some embodiments, mattress 100 is used as a mattress (e.g., a base) for an integrated tent/mattress assembly as described herein. In certain embodiments, mattress 100 includes two elongated chambers 102A, 102B attached to mattress chamber 104. Elongated chambers 102A, 102B may be attached to mattress chamber 104 along the length of the mattress chamber.

Chambers 102A, 102B and chamber 104 may be made from strong, pliant materials that can be inflated/deflated repeatedly. For example, chambers 102A, 102B and chamber 104 may be made from Kevlar, neoprene, or another similar washable polymer material. In the deflated stated shown in FIG. 1, the materials for chambers 102A, 102B and chamber 104 allow mattress 100 to be folded or rolled into a compact shape. The rolled, compact shape may allow mattress 100 to be more easily transported and/or stored. For example, mattress 100, when in the compact shape, may be placed in a backpack, tent bag, or duffel bag for transport and/or storage.

In the inflated state, shown in FIGS. 2 and 3, chambers 102A, 102B may form elongated shapes such as tubulars or cylinders. Chambers 102A, 102B may, for example, resemble pontoons when inflated. Chamber 104 may form a rectangular table (mattress) shape when inflated. When inflated, chamber 104 may form a shape substantially similar to a thin mattress for supporting a human body. For example, in certain embodiments, chamber 104, when inflated, may include upper surface 104A, lower surface 104B (also shown in FIG. 5), longitudinal edges 104C and 104D, top edge 104E, and bottom edge 104F (it should be noted that top edge 104E and bottom edge 104F are described for descriptional purposes only and that either edge can be the top or bottom during use of mattress 100). In some embodiments, as shown in FIG. 2, chamber 104 may have rounded corners and/or one or more rounded sides (e.g., the shorter sides in the depiction of the chamber). In certain embodiments, chamber 104 has a firm (e.g., rigid) upper surface when inflated to support the human body. Additionally, chambers 102A, 102B may be firm and strong when inflated to provide support for chamber 104 and the human body (e.g., support for a person lying on mattress 100).

In certain embodiments, as shown in FIGS. 2 and 3, upper surface 104A and lower surface 104B are planar or flat surfaces. When chambers 102A, 102B are inflated, lower surface 104B of chamber 104 may be raised by chambers 102A, 102B to the inflated height of chambers 102A, 102B. The inflated height of chambers 102A, 102B (and thus lower surface 104B of chamber 104) may be a partially inflated height (chambers 102A, 102B are partially inflated) or a fully inflated height (chambers 102A, 102B are fully inflated).

In certain embodiments, when chambers 102A, 102B and lower surface 104B are at the inflated height, lower surface 104B is in tangential contact with both of chambers 102A, 102B along the outer surfaces of the chambers. In some embodiments, when chambers 102A, 102B and lower surface 104B are at the inflated height, lower surface 104B is in contact with the uppermost inflated points (with respect to a ground surface that mattress 100 may be placed onto (e.g., points 132A, 132B shown in FIG. 3)) of chambers 102A, 102B (e.g., the highest points of the chambers above the ground surface when the chambers are inflated). With lower surface 104B being in contact with the uppermost inflated points of chambers 102A, 102B, chamber 104 is positioned above chambers 102A, 102B with substantially all of chamber 104 being positioned above the inflated heights of chambers 102A, 102B when mattress 100 is inflated. In some embodiments, points 132A, 132B represent attachment points between chamber 104 and chambers 102A, 102B.

As described above, chambers 102A, 102B, when inflated, may provide support to chamber 104 (and a human body positioned on chamber 104). In certain embodiments, as shown in FIG. 3, longitudinal edges 104C, 104D of chamber 104 are positioned beyond the centers (shown by lines 130A, 130B) of chambers 102A, 102B (e.g., longitudinal edges 104C, 104D of chamber 104 extend wider than the centers of chambers 102A, 102B). With the edges of chamber 104 positioned beyond the centers of chambers 102A, 102B, at least a portion of lower surface 104B is in contact (e.g., tangential contact) with the centers of chambers 102A, 102B at the uppermost inflated heights (e.g., points 132A, 132B shown in FIG. 3) of the chambers. Thus, having the edges of chamber 104 (longitudinal edges 104C, 104D) positioned beyond the centers of chambers 102A, 102B may provide support for chamber 104 when mattress 100 is inflated and used to support a human body. Providing support may include, for example, preventing chamber 104 from sagging between chambers 102A, 102B when a human body is supported by chamber 104.

In certain embodiments, as shown in FIG. 3, chambers 102A, 102B have at least some portion that extends beyond the longitudinal edges of chamber 104, when chambers 102A, 102B are inflated and lower surface 104B is at the inflated height. For example, about ¼ to ½ of chambers 102A, 102B may be positioned beyond longitudinal edges 104C, 104D of chamber 104 (e.g., at least about ¼ to ½ of chambers 102A, 102B extend wider than longitudinal edges 104C, 104D). Having portions of chambers 102A, 102B positioned beyond longitudinal edges 104C, 104D may provide additional stability in mattress 100. For example, chambers 102A, 102B may have portions underneath chamber 104 that provide support to chamber 104 (as described above) while the portions of the chambers that are wider than longitudinal edges 104C, 104D of chamber 104 provide a wider base that improves the stability of mattress 100 (e.g., inhibits mattress 100 from tipping over with a human body on the mattress). Additionally, the use of two elongated chambers 102A, 102B provides more stability than if only one chamber is used to support mattress chamber 104.

Figure 4:
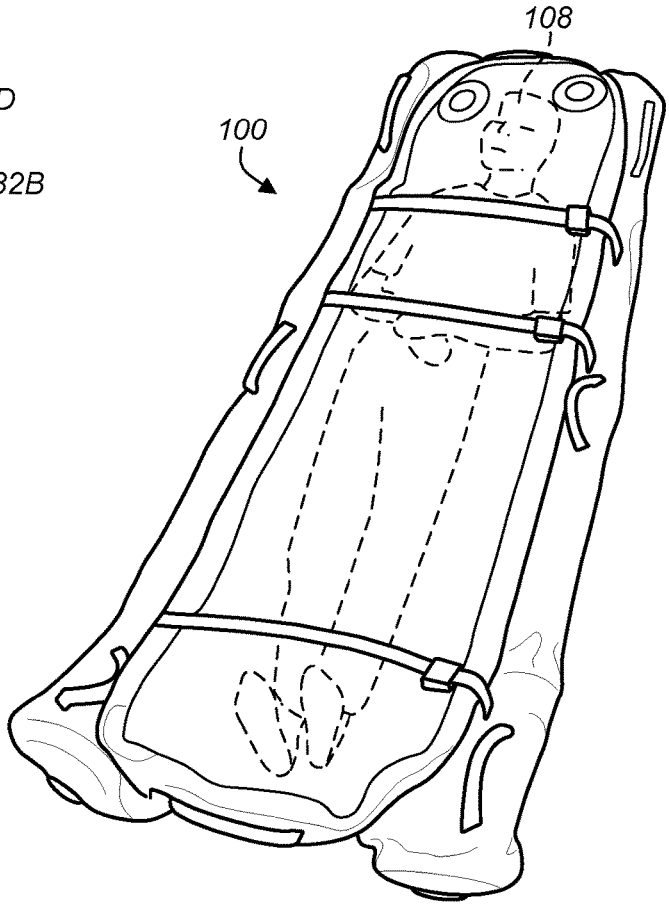
FIG. 4 depicts a top perspective view of an embodiment of a human body secured to an inflatable mattress (in a deflated state) with straps.

In certain embodiments, as shown in FIGS. 1 and 2, mattress 100 includes one or more straps 106 attached to chamber 104. Straps 106 may be used to secure a human body to chamber 104 and mattress 100. FIG. 4 depicts a top perspective view of an embodiment of human body 108 secured to mattress 100 (in a deflated state) with straps 106. Straps 106 may be, for example, adjustable and/or tensioned straps that can securely hold a body on mattress 100.

In certain embodiments, as shown in FIGS. 1, 2, and 4, mattress 100 includes one or more handles 110 attached to chambers 102A, 102B and chamber 104. Handles 110 may be used to lift or maneuver mattress 100 when in either a deflated or inflated state. Handles 110 may be positioned at multiple locations around the perimeter of chambers 102A, 102B and chamber 104 to allow one or more personnel (e.g., a camper) to easily grasp and maneuver mattress 100. Handles 110 may be positioned closer to an upper surface of mattress 100. Positioning handles 110 closer to the top of mattress 100 may allow easier access to the handles.

In certain embodiments, the upper surface of rectangular mattress chamber 104 includes material surface 112, as shown in FIGS. 1 and 2. Material surface 112 may include, for example, a cloth, felt, fiber surface, or other textured material. In some embodiments, material surface 112 includes washable material. In some embodiments, material surface 112 has a coefficient of friction that is high enough to inhibit a human body (or other object) from sliding off mattress 100 (e.g., when the mattress is used for sleeping or camping embodiments described herein).

Figure 5:
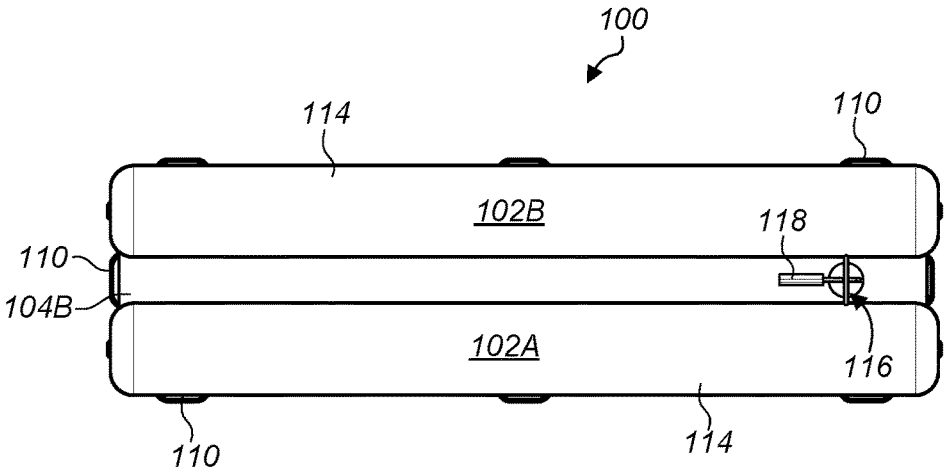
FIG. 5 depicts a bottom perspective view of an embodiment of an inflatable mattress in an inflated state.

FIG. 5 depicts a bottom perspective view of an embodiment of mattress 100 in an inflated state. In certain embodiments, the bottom surface of chambers 102A, 102B include material surfaces 114. Material surfaces 114 may include, for example, cloth, felt, or fiber surfaces. In some embodiments, material surfaces 114 include washable material. Material surfaces 114 may be sliding material surfaces that provide sliding or gliding surfaces for maneuvering mattress 100 on, over, and around various surfaces (e.g., sand, dirt, rocks, etc.). In some embodiments, material surfaces 114 have coefficients of friction that are low enough to allow mattress 100 to slide on a number of different surfaces (e.g., wood, grass, etc.). The coefficients of friction, however, may also be high enough to inhibit mattress 100 from sliding too easily such that the mattress will slide uncontrollably. In some embodiments, the coefficient of friction is high enough to inhibit mattress 100 from undesired movement when placed on a ground surface (e.g., when the mattress is used for sleeping or camping embodiments described herein). In some embodiments, material surfaces 114 include protective materials (e.g., Kevlar) that inhibit punctures or other damage to chambers 102A, 102B (e.g., material surfaces 114 may inhibit ground punctures when the mattress is used for sleeping or camping embodiments described herein).

Figure 6:
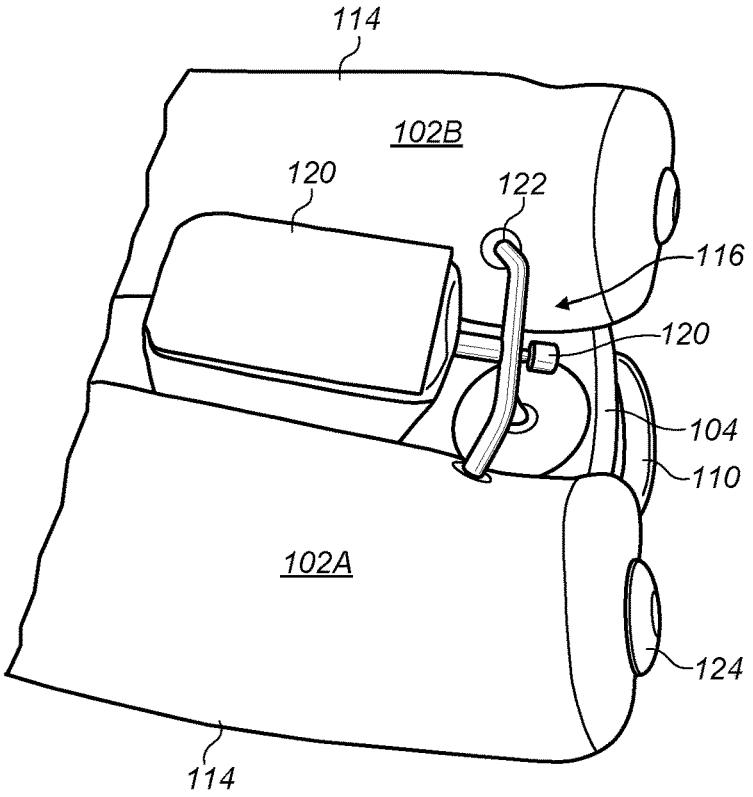
FIG. 6 depicts an enlarged perspective view of an embodiment of an inflation device attached to an inflatable mattress.

In certain embodiments, as shown in FIG. 5, inflation device 116 is attached to mattress 100. Inflation device 116 may, for example, be attached to a lower surface of chamber 104 between chambers 102A, 102B. FIG. 6 depicts an enlarged perspective view of an embodiment of inflation device 116 attached to mattress 100. Inflation device 116 may be positioned between chambers 102A, 102B and near chamber 104. Positioning inflation device 116 between chambers 102A, 102B may provide protection for the inflation device from being inadvertently struck or damaged. Positioning inflation device 116 between chambers 102A, 102B may also allow the inflation device to be protected and secured when mattress 100 is rolled or folded for storage or transport. In some embodiments, inflation device 116 is covered to further protect the inflation device. For example, inflation device 116 may be positioned in a pouch attached to chamber 104. The pouch may further protect and secure inflation device 116.

In certain embodiments, inflation device 116 includes compressed gas cylinder 118, regulator valve 120, and gas lines 122. Gas cylinder 118 may be a standard compressed gas cylinder. For example, gas cylinder 118 may be a compressed carbon dioxide gas cylinder. Gas cylinder 118 may be of sufficient size to provide gas for more than one inflation of mattress 100 while being sized to be positioned between chambers 102A, 102B. For example, gas cylinder 118 may be a 20-ounce tank of compressed carbon dioxide.

Gas cylinder 118 may be coupled to, or include, regulator 120. Regulator valve 120 may be a user operated valve to control the flow of gas into chambers 102A, 102B and chamber 104. Gas may be provided to chambers 102A, 102B and chamber 104 through gas lines 122. Regulator valve 120 may control (regulate) the flow of compressed gas into chambers 102A, 102B and 104 when the valve is opened. The flow of compressed gas may be controlled to control or regulate the inflation time for chambers 102A, 102B and chamber 104. Thus, when regulator 120 is opened, compressed gas controllably flows into chambers 102A, 102B and chamber 104 and fills the chambers in a desired amount of time and/or for a desired sleeping comfort level.

Mattress 100 may be inflated by providing compressed gas from inflation device 116 into chambers 102A, 102B and chamber 104. Inflation of the chambers inflates mattress 100 to an inflated state. In the inflated state, chambers 102A, 102B provide support to mattress chamber 104 (e.g., the "mattress" of mattress 100). Because chambers 102A, 102B are tubular "pontoons" and chamber 104 is a thin, relatively flat chamber, less gas is used to inflate mattress 100 than if an entire mattress with the same cross-section as chambers 102A, 102B and chamber 104 was inflated (e.g., mattress 100 with chambers 102A, 102B and chamber 104 uses less gas to inflate than would a single chamber mattress having the same outer dimensions as mattress 100).

In certain embodiments, mattress 100 is inflated to a selected height. In some embodiments, the selected height is a comfortable height for sleeping or camping embodiments described herein. For example, the selected height may be at least about 4", at least about 6", or at least about 8". Other heights may also be contemplated depending on a use of mattress 100.

In certain embodiments, mattress 100 is inflated to the selected height in a desired amount of time. For example, in some embodiments, mattress 100 is inflated to the selected height in less than about 2 minutes. In some embodiments, mattress 100 is inflated to the selected height in less than about 60 seconds or less than about 90 seconds. The desired time for inflation of mattress may be controlled or adjusted by adjusting operation of regulation valve 120 (e.g., adjusting the release rate of gas into chambers 102A, 102B and chamber 104).

In certain embodiments, chambers 102A, 102B and chamber 104 include pressure relief valves 124, as shown in FIGS. 1-4. Pressure relief valves 124 may be used to deflate chambers 102A, 102B and chamber 104 after use. Pressure relief valves 124 may controllably release gas from chambers 102A, 102B and chamber 104 and deflate the chambers in a desired amount of time and/or to adjust the desired sleeping comfort level. Pressure relief valves 124 may be operated to release air from the chambers as needed and/or desired. In certain embodiments, mattress 100 is deflated by releasing gas through pressure valves 124. Mattress 100 may be cleaned as needed and rolled into a rolled-up (or folded) state and placed in a carry bag, if desired.

In some embodiments, mattress 100 is used to assist in lifting and transporting a human body (e.g., a human corpse), as shown in FIGS. 7-10. For example, for human corpses, mattress 100 may be transported to a location the human corpse departed from life (e.g., the location of death). In certain embodiments, mattress 100 is used for sleeping (e.g., with a tent coupled to the mattress as described herein) or other uses where a person lies down on the mattress. Mattress 100 may be transported to the location of use (e.g., a camping site) in a deflated state. In some embodiments, mattress 100 is transported to the location in a rolled-up (or folded) state (e.g., the mattress is rolled or folded into a compact shape and transported to the location). In some embodiments, mattress 100 is transported in the rolled-up (or folded) state in a carry bag (e.g., a hand carried bag, duffel, or backpack).

Figure 7:
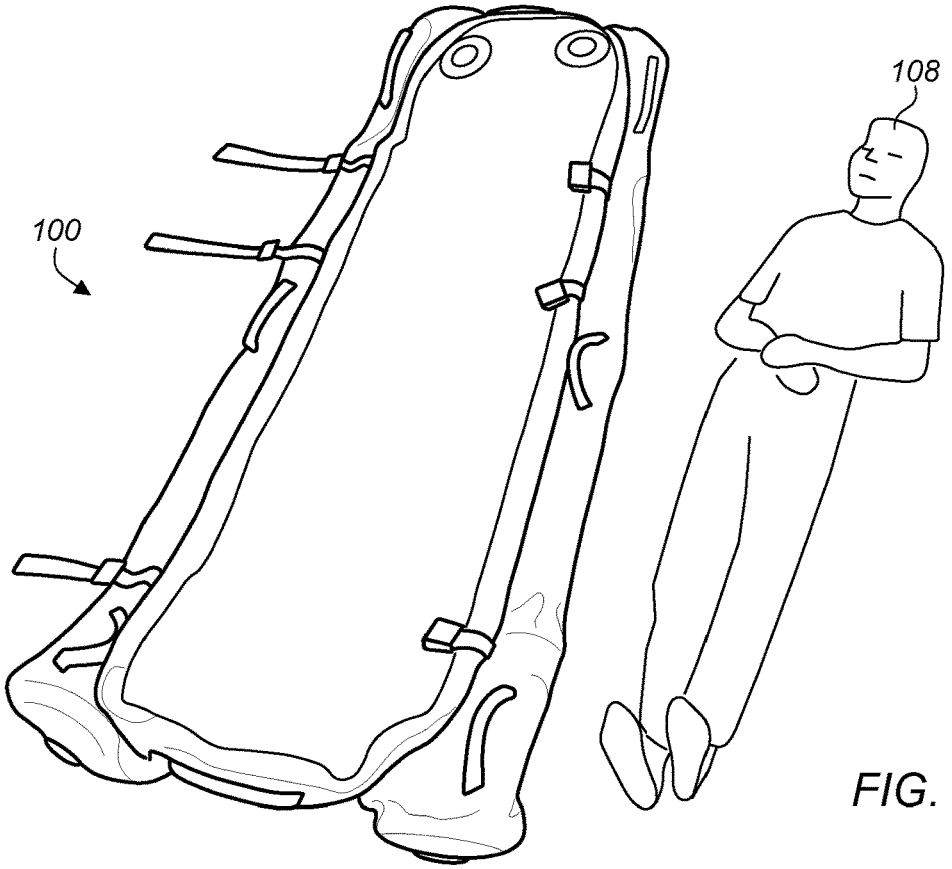
FIG. 7 depicts a representation of an inflatable mattress positioned adjacent to a human body.

FIGS. 7-10 depict embodiments using mattress 100 to assist in lifting and transporting a human body (e.g., a human corpse). In certain embodiments, when mattress 100 is used to assist in lifting and transporting a human body, after mattress 100 is placed adjacent to human body 108 (e.g., a human corpse) at the location of the human body, the mattress is unrolled or unfolded (if in rolled-up or folded state) and positioned next to human body 108, as shown in FIG. 7. After mattress 100 is positioned next to human body 108, the human body may be moved onto the mattress, which is in a deflated state, as shown in FIG. 4. In some embodiments, human body 108 is moved onto mattress 100 by at least partially lifting the human body and sliding the mattress underneath the human body (e.g., log rolling the human body and placing the mattress under the human body). In some embodiments, an additional device is used to assist in placing human body 108 on mattress 100. For example, a thin board, such as a Smooth Mover or other polyethylene board, may be slid under human body 108 and used to assist in lifting the human body onto mattress 108.

Figure 8:
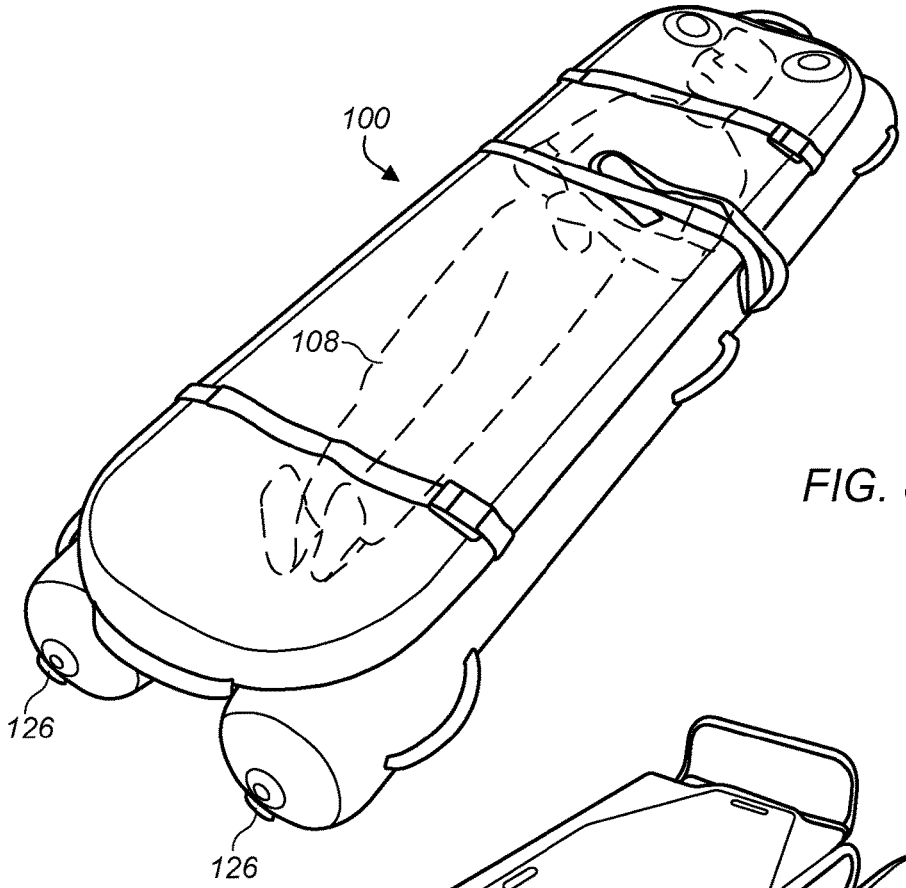
FIG. 8 depicts a representation of an embodiment of a human body on an inflatable mattress in an inflated state.

After human body 108 is positioned on mattress 100, the human body may be secured to the mattress using straps 106, as shown in FIG. 4. Once human body 108 is secured to mattress 100, the mattress may be inflated using, for example, inflation device 116 (shown in FIGS. 5 and 6). FIG. 8 depicts a representation of an embodiment of human body 108 on mattress 100 in an inflated state.

Figure 9:
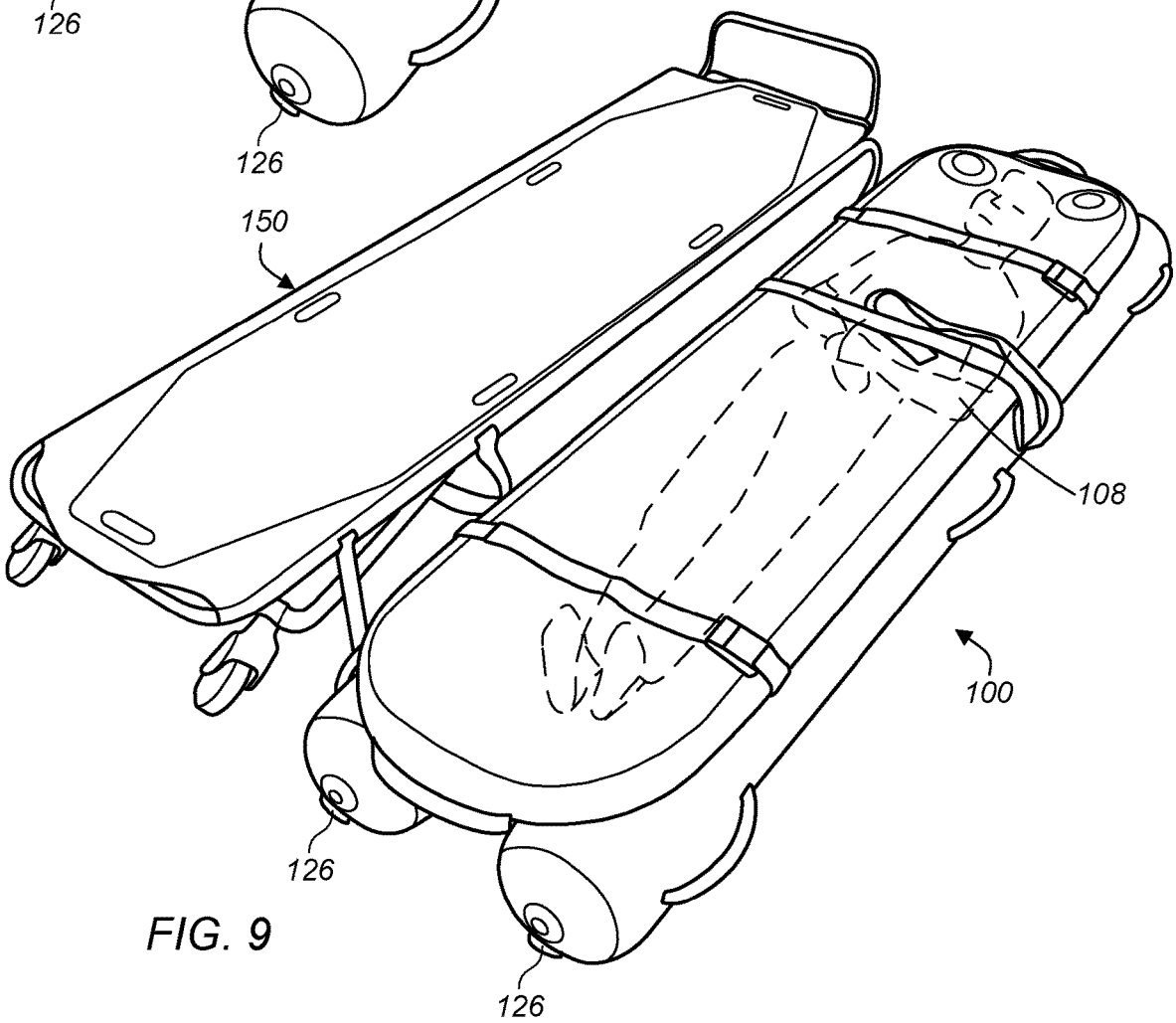
FIG. 9 depicts a representation of an embodiment of a human body on an inflatable mattress, in the inflated state, positioned next to a gurney.

After mattress 100 is inflated, as shown in FIG. 8, the mattress may be moved, along with the attached human body 108, to another location (e.g., a location of a gurney, stretcher, or mortuary cot (such as a collapsible, wheeled cot typically used to carry and move a corpse from a remote location to a mortuary)). FIG. 9 depicts a representation of an embodiment of human body 108 on mattress 100, in the inflated state, positioned next to gurney 150.

To move mattress 100 with human body 108 attached, personnel may grab the mattress using handles 110. Handles 110 are positioned to allow personnel to easily grab and move mattress 100 with human body 108 on the mattress. Handles 110 on the ends of mattress 100 (e.g., the handles attached to chamber 104) may be positioned higher and easier for the personnel to grab and lift the mattress. Handles 110 on the side of mattress 100 (e.g., the handles attached to chambers 102A, 102B) may be used for additional grabbing and manipulation of the mattress. In some embodiments, handles 110 may include extensions or have extensions attached to the handles. The extensions may allow grabbing of mattress 100 at increased distances from the mattress.

Because mattress 100 is an inflatable structure inflated with gas to provide a firm and stable support for human body 108, mattress 100 may have a relatively light weight. For example, in certain embodiments, mattress 100 may have a weight of at most about 20 pounds. In some embodiments, mattress 100 may have a weight of at most about 15 pounds or at most about 10 pounds.

With the light weight, mattress 100 provides a stable platform for moving human body 108 from one location to another (e.g., from the location of death to the location of gurney 150). While providing a lightweight and stable platform, mattress 100 may also be moved between locations more easily than other mattresses or corpse support apparatus. The structure of mattress 100 allows the mattress to flex and/or bend while human body 108 is attached to the mattress. For example, the shape and construction of chambers 102A, 102B and chamber 104 allow mattress 100 to flex and/or bend while inflated. Flexing and/or bending of mattress 100 while moving the mattress allows the mattress to be more easily maneuvered around corners, through doorways, and over or around objects. Additionally, as chambers 102A, 102B include material surfaces 114 (shown in FIG. 5), mattress 100 may be glided or slid over surfaces such as floors, stairs, hallways, or wall corners. The gliding movement of mattress 100 allows personnel to more easily move the mattress between locations, especially for human bodies of greater weight that may be more difficult to lift and carry off the floor (e.g., corpses above about 250 pounds).

In some embodiments, mattress 100 includes wheels 126 (shown in FIG. 9) to assist in movement of the mattress. Wheels 126 may include, for example, casters or other wheels positioned in, or attached to, the ends of chambers 102A, 102B. Wheels 126 may allow mattress 100 to be more easily maneuvered and/or allow fewer personnel to maneuver the mattress.

Figure 10:
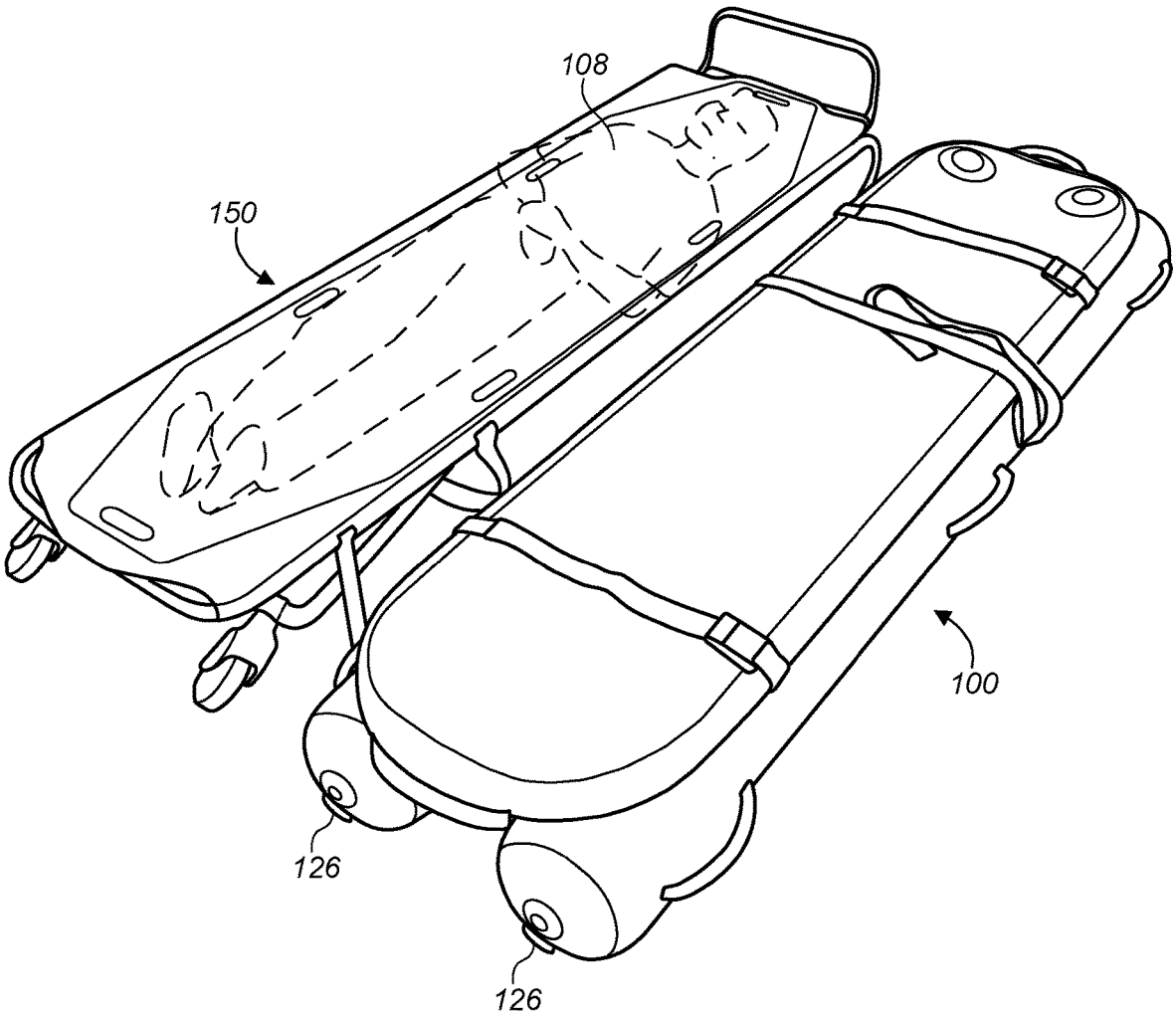
FIG. 10 depicts a representation of an embodiment of a human body having been moved to a gurney from an inflatable mattress.

After mattress 100 and human body 108 are moved to the location of gurney 150, as shown in FIG. 9, the corpse may be transferred to the gurney. FIG. 10 depicts a representation of an embodiment of human body 108 having been moved to gurney 150 from mattress 100. In the inflated state, mattress 100 raises human body 108 to substantially the same height as the upper surface of gurney 150 (which may be in a collapsed or folded down position). Because the upper surfaces of mattress 100 and gurney 150 are at substantially the same height, transferring of human body 108 from the mattress to the gurney is relatively easy. In some embodiments, human body 108 is transferred using a Smooth Mover or other thin board (which may have remained positioned under the corpse on the mattress). After human body 108 is transferred to gurney 150, the human body may be moved (transported) to another location such as a mortuary or coroner's office using the gurney. In some embodiments, mattress 100 may allow human body 108 to be moved to another location (e.g., the mortuary or coroner's office) without the use of gurney 150.

Figure 11:
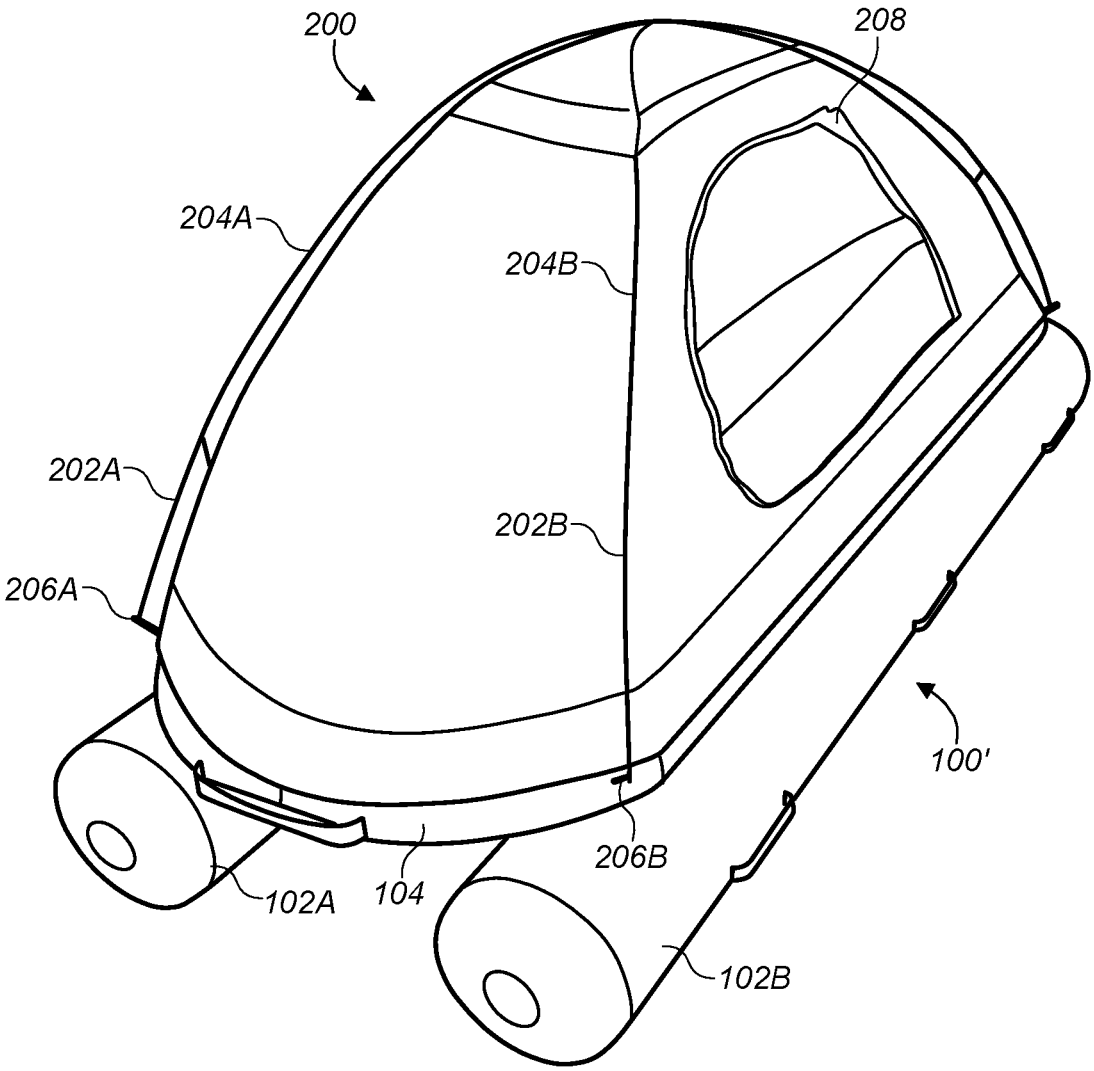
FIG. 11 depicts a perspective view representation of an embodiment of an inflatable mattress, in an inflated state, with a tent coupled to the mattress.
Figure 12:
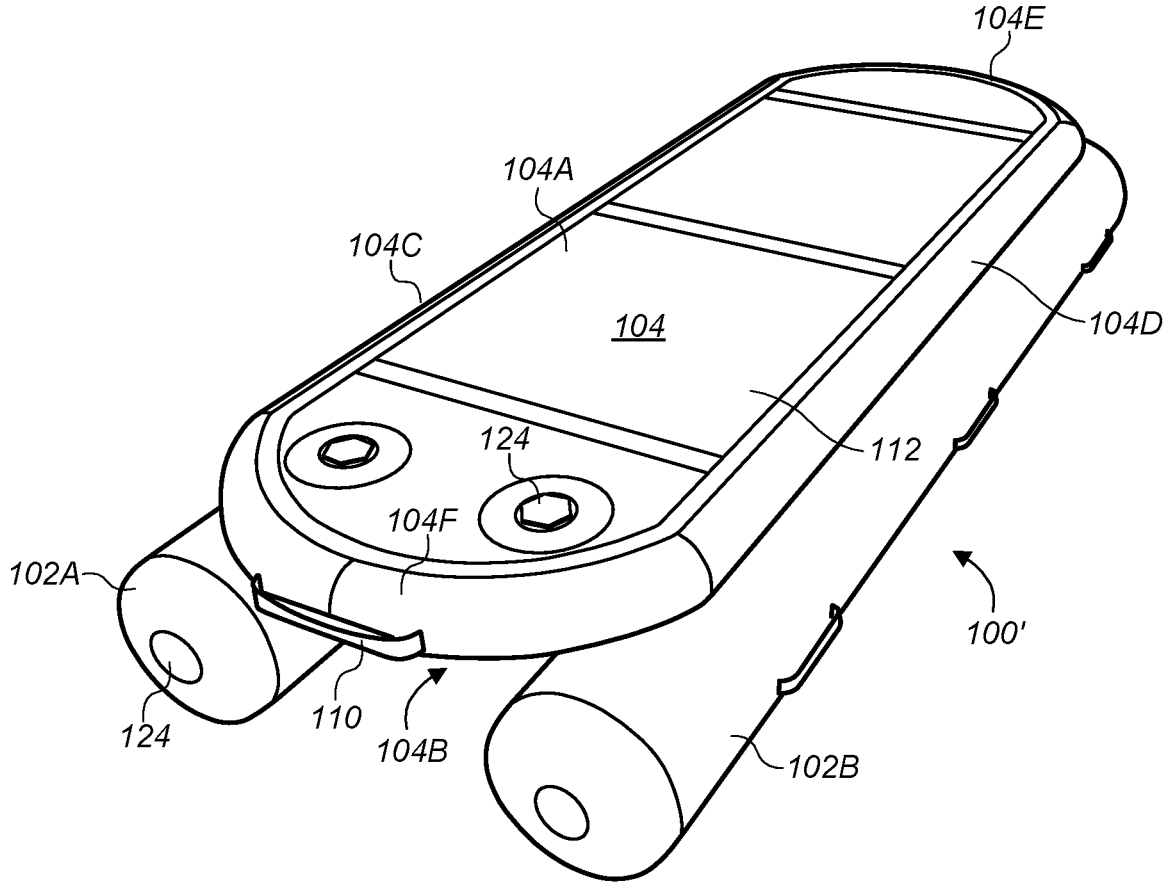
FIG. 12 depicts a top perspective view of an embodiment of an inflatable mattress, in an inflated state, without an attachment.

In certain embodiments, one or more attachments are added to mattress 100 to allow for additional uses of the mattress (e.g., sleeping and/or camping embodiments). FIG. 11 depicts a perspective view representation of an embodiment of inflatable mattress 100', in an inflated state, with tent 200 coupled (e.g., attached) to the mattress. Mattress 100' may be substantially similar to mattress 100 described herein. FIG. 12 depicts a top perspective view of an embodiment of inflatable mattress 100', in an inflated state, without an attachment. In some embodiments, mattress 100' is substantially similar to mattress 100 (shown in, for example, FIG. 2) without (or with different numbers of) straps 106, handles 110, and/or wheels 126. In some embodiments, mattress 100' has different sized chambers 102A, 102B and/or chamber 104. The sizes of chambers 102A, 102B and/or chamber 104 may be selected for the use of mattress 100' (e.g., sized for a tent attachment or for another attachment). In certain embodiments, mattress 100' is sized for a single person. Other sizes of mattress 100' may, however, also be contemplated (e.g., mattress 100' may be sized for 2 people with a 2-person tent attachment). In certain embodiments, mattress 100' includes material surface 112. Material surface 112 may provide grip or friction to inhibit a person or object (e.g., sleeping bag) from sliding off of mattress 100' (as described above).

In certain embodiments, as shown in FIG. 11, tent 200 is coupled (e.g., attached) to mattress 100'. Tent 200 may be coupled to chamber 104 of mattress 100' (e.g., the mattress chamber). Tent 200 may be coupled to mattress 100' using, for example, Velcro attachments, zippers, and/or stitching. Other coupling methods may also be used such as, but not limited to, glue or fasteners. In some embodiments, tent 200 is permanently attached to mattress 100' (e.g., using stitching or glue). In some embodiments, tent 200 is removably attached to mattress 100' (e.g., using Velcro, zippers, or another temporary attachment method). Tent 200 may be a portable shelter or other shelter used for camping or similar uses. Tent 200 may, for example, be a collapsible shelter similar to a typical backpacking or camping tent that is collapsed and stored in a tent bag.

FIG. 11 depicts tent 200 in an erected (deployed) state. In certain embodiments, tent 200 is erected using poles 202. For example, tent 200 may be erected using two crisscrossing poles 202A, 202B. To erect tent 200, ends of poles 202A, 202B may be inserted into pole insertion ends 204A, 204B while the poles are passed through tent sleeves 206A, 206B. Insertion ends 204A, 204B may be, for example, grommets or other insertion holes or devices used for tent poles. Tent sleeves 206A, 206B may be sleeve portions that are part of or attached to the ten that allow poles 202A, 202B to raise and support the walls of tent 200.

Tent 200 may be made of any suitable tent material. For example, tent 200 may be made of Kevlar or another lightweight material known to be used for backpacking or camping tents. Poles 202A, 202B may be made of lightweight, flexible, and strong materials such as, but not limited to, aluminum, titanium, or carbon fiber. In certain embodiments, poles 202A, 202B are removed from tent 200 when the tent is collapsed (e.g., the poles and the tent are separate pieces). Poles 202A, 202B may also be collapsed for storage and transport. For example, poles 202A, 202B may include one or more portions that are coupled together using shock cord as is known in the art. In certain embodiments, tent 200 includes door 208. Door 208 may be, for example, a zippered tent door or another suitable tent door used to allow a person to enter/exit the tent. Door 208, when closed, may be impervious to outside elements (e.g., the door may provide a weather proof enclosure when closed).

Figure 13:
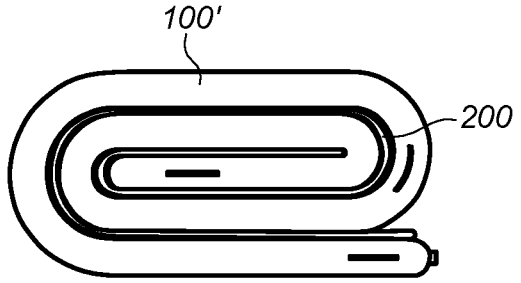
FIG. 13 depicts a side-view representation of an embodiment of an inflatable mattress and a coupled tent rolled into a compact shape.

When tent 200 is collapsed on mattress 100' and the mattress is deflated, the tent and mattress may be rolled-up or folded-up together into a compact shape. In certain embodiments, poles 202A, 202B are removed to allow rolling or folding of tent 200 and mattress 100'. FIG. 13 depicts a side-view representation of an embodiment of mattress 100' and tent 200 rolled into a compact shape. In certain embodiments, mattress 100' and tent 200, when in the compact shape, may be placed in a backpack, duffel bag, or other suitable bag for transport and/or storage. Placing mattress 100' and tent 200 in, for example, a backpack may allow the mattress/tent combination to be more easily transported for backpacking or other camping type activities.

While FIG. 11 depicts one embodiment of tent 200, it is to be understood that the tent coupled to mattress 100' may include other tent designs and/or structures without departing from the spirit and scope of the invention as described herein and in the claims. For example, tent 200 may be erected with a different number of poles, use poles that are integrated into the tent (e.g., similar to a roof-top tent), have a different shape, and/or a different number of entrances than the embodiment depicted in FIG. 11. Tent 200 may also include other elements not depicted in FIG. 11 such as, but not limited to, LED lights, hooks or attachment loops, and/or a rain fly (including rain fly attachment devices).

As described herein, mattress 100' is an inflatable structure inflated with gas to provide firm and stable support with an adjustable comfort level for a camper or person using the mattress for sleeping or lying down. As mattress 100' and tent 200 include lightweight materials and the mattress uses gas for inflation, the mattress and tent may together have a relatively light weight. For example, in certain embodiments, mattress 100' and tent 200 may have a weight of at most about 20 pounds. In some embodiments, mattress 100' and tent 200 may have a weight of at most about 15 pounds or at most about 10 pounds.

With the light weight, mattress 100' provides a stable platform for campers. In some embodiments, the structure of mattress 100' allows the mattress (and tent 200) to float on water. Mattress 100' may also flex and/or bend while moving the mattress. For example, the shape and construction of chambers 102A, 102B and chamber 104 may allow mattress 100' to flex and/or bend while inflated. Flexing and/or bending of mattress 100' while moving the mattress allows the mattress to be more easily maneuvered around, trees, brush, and over or around objects. Additionally, as chambers 102A, 102B include material surfaces 114 (shown in FIG. 5), mattress 100' may be glided or slid over surfaces such as grass, dirt, rocks, etc. The gliding movement of mattress 100' allows a person to more easily move the mattress between camping locations.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a portion" includes a combination of two or more portions and reference to "a material" includes mixtures of materials.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An inflatable apparatus, comprising:

an inflatable mattress, the inflatable mattress comprising an inflatable mattress chamber in fluid communication with two elongated inflatable chambers, the two elongated inflatable chambers being positioned lengthwise along longitudinal edges of the inflatable mattress chamber, wherein the two elongated inflatable chambers are positioned at least partially underneath the longitudinal edges of the inflatable mattress chamber, wherein at least a portion of each of the two elongated chambers extend beyond a width of the longitudinal edges of the inflatable mattress chamber; and wherein the inflatable mattress chamber includes a top planar surface and a bottom planar surface when inflated;

an inflation device coupled to the inflatable mattress chamber and the two elongated inflatable chambers, the inflation device configured to inflate the inflatable mattress chamber and the two elongated inflatable chambers to raise the inflatable mattress chamber to a selected inflated height;

wherein, when inflated, the two elongated inflatable chambers have an inflated height, and wherein the bottom planar surface of the inflatable mattress chamber is in tangential contact with both of the two elongated inflatable chambers along their outer surfaces at the inflated height of the two elongated inflatable chambers; and a portable shelter coupled to an upper surface of the inflatable mattress chamber.

2. The apparatus of claim 1, wherein top planar surface of the inflatable mattress chamber comprises a firm surface that supports a human body when inflated.

3. The apparatus of claim 1, wherein at least a portion of each of the two elongated chambers provide support for the inflatable mattress chamber when inflated.

4. The apparatus of claim 1, wherein the top planar surface of the inflatable mattress chamber comprises a surface material that inhibits sliding of an object on the top planar surface of the inflatable mattress chamber.

5. The apparatus of claim 1, wherein the portable shelter comprises a collapsible tent.

6. The apparatus of claim 1, further comprising one or more poles configured to couple to and support the portable shelter.

7. The apparatus of claim 1, wherein the inflation device comprises a compressed gas cylinder attached to the inflatable mattress.

8. An inflatable apparatus, comprising:

an inflatable mattress chamber, wherein the inflatable mattress chamber includes a top planar surface and a bottom planar surface when inflated;

two elongated inflatable chambers in fluid communication with the inflatable mattress chamber, the two elongated inflatable chambers being positioned lengthwise along longitudinal edges of the inflatable mattress chamber; wherein at least some portion of the two elongated chambers extends beyond the longitudinal edges of the bottom surface of the inflatable mattress chamber;

an inflation device coupled to the inflatable mattress chamber and the two elongated inflatable chambers, the inflation device configured to inflate the inflatable mattress chamber and the two elongated inflatable chambers to raise the inflatable mattress chamber to a selected inflated height; and a portable shelter coupled to an upper surface of the inflatable mattress chamber;

wherein the two elongated inflatable chambers are positioned at least partially underneath the longitudinal edges of the bottom planar surface of the inflatable mattress chamber with the longitudinal edges of the bottom planar surface of the inflatable mattress chamber extending wider than centers of the two elongated inflatable chambers.

9. The apparatus of claim 8, wherein the top planar surface of the inflatable mattress chamber comprises a firm surface that supports a human body when inflated.

10. The apparatus of claim 8, wherein at least a portion of the bottom planar surface of the inflatable mattress chamber is in contact with the centers of the two elongated inflatable chambers at uppermost inflated heights of the two elongated inflatable chambers when the two elongated inflatable chambers are inflated.

11. The apparatus of claim 8, wherein the portable shelter comprises a collapsible tent.

12. The apparatus of claim 8, further comprising one or more poles configured to couple to and support the portable shelter.

13. An inflatable apparatus, comprising:

an inflatable mattress chamber;

two separate, elongated inflatable chambers coupled to the inflatable mattress chamber, wherein the two separate, elongated inflatable chambers are in fluid communication with the inflatable mattress chamber, the two separate, elongated inflatable chambers being positioned in parallel lengthwise along opposing longitudinal edges of the inflatable mattress chamber; wherein at least ¼ to ½ of the two separated, elongated inflatable chambers extend wider than the longitudinal edges of the inflatable mattress chamber;

an inflation device coupled to the inflatable mattress chamber and the two elongated inflatable chambers, the inflation device configured to inflate the inflatable mattress chamber and the two elongated inflatable chambers to raise the inflatable mattress chamber to a selected inflated height; and a portable shelter coupled to an upper surface of the inflatable mattress chamber;

wherein the two elongated inflatable chambers are positioned at least partially underneath the longitudinal edges of the inflatable mattress chamber; and wherein, when the two elongated inflatable chambers and a lower surface of the inflatable mattress chamber are at the selected inflated height, the lower surface of the inflatable mattress chamber is in contact with uppermost inflated points of the two elongated inflatable chambers, the uppermost inflated points being the uppermost points with respect to a ground surface configured for the two elongated inflatable chambers.

14. The apparatus of claim 13, wherein the inflatable mattress chamber is positioned above the two separate elongated inflatable chambers with substantially all of the inflatable mattress chamber being positioned above the inflated heights of the two separate, elongated inflatable chambers when the two separate elongated inflatable chambers are inflated.

15. The apparatus of claim 13, wherein the uppermost inflated points comprise attachment points between the two separate, elongated inflatable chambers and the inflatable mattress chamber.

16. The apparatus of claim 13, wherein the portable shelter comprises a collapsible tent.

17. The apparatus of claim 13, further comprising one or more poles configured to couple to and support the portable shelter.

* * * * *